US005119147A

United States Patent [19]

Hays

[11] Patent Number: 5,119,147

[45] Date of Patent: Jun. 2, 1992

[54] SELECTIVE COLORING OF BI-LEVEL LATENT ELECTOSTATIC IMAGES

[75] Inventor: Dan A. Hays, Fairport, N.Y.

[73] Assignee: Xerox Corporation, Stamford, Conn.

[21] Appl. No.: 632,563

[22] Filed: Dec. 24, 1990

[51] Int. Cl.[5] ..... G03G 15/01

[52] U.S. Cl. ..... 355/326; 118/645; 118/654; 355/247

[58] Field of Search ..... 118/645, 647, 648, 654; 355/326, 327, 328, 247, 261, 262, 265, 266, 267, 259; 346/157

[56] References Cited

U.S. PATENT DOCUMENTS

| | | | |
|---|---|---|---|
| 3,554,161 | 1/1971 | Blanchette | 118/647 X |
| 3,914,460 | 10/1975 | Maksymiak | 118/647 X |
| 4,568,955 | 2/1986 | Hosoya et al. | 346/153.1 |
| 4,710,016 | 12/1987 | Waatanabe | 355/326 |
| 4,742,373 | 5/1988 | Nakatani | 355/202 |
| 4,752,802 | 6/1988 | Ito et al. | 355/268 X |
| 4,754,301 | 6/1988 | Kasamura et al. | 355/326 X |
| 4,811,046 | 3/1989 | May | 355/326 |
| 4,868,600 | 9/1989 | Hays et al. | 355/259 |
| 4,913,348 | 4/1990 | Hays | 430/45 |

*Primary Examiner*—A. T. Grimley
*Assistant Examiner*—William J. Royer

[57] ABSTRACT

Selective coloring of bi-level latent electrostatic images is obtained through a combination of 1) a scavengeless development nip enabled by an AC biased wire in self-spaced contact with a toned donor roll, 2) a belt image receiver such as either a photoreceptor or electroreceptor without a ground plane and 3) an array of addressable, stationary electrodes positioned behind the belt in alignment with the AC biased wire. Selective coloring of the electrostatic image is obtained by selectively DC biasing addressable, stationary electrode structures forming electrode arrays positioned behind the belt. By controlling the level and timing for applying a DC bias to each electrode segment, the developability can be switched on and off with x,y addressability in the plane of the electrostatic image. Thus, with a system having resident multi-colored development systems, different areas of the electrostatic image can be developed in a single pass with different colors and perfect registration simply by controlling the DC electrical signals to the electrodes.

26 Claims, 3 Drawing Sheets

SELECTIVE COLORING OF BI-LEVEL LATENT ELECTOSTATIC IMAGES

BACKGROUND OF THE INVENTION

This invention relates generally to highlight color imaging and more particularly to an image creation method and apparatus wherein contrasting images are formed by selectively developing an electrostatic image with colored or otherwise distinctive toners.

It is common practice to add information to the face of a document or to highlight certain portions of it by underlining. It is also common to delete portions of the document either by crossing out information or by covering it with a blank piece of paper. As will be appreciated, writing data or underlining on the document spoils the original document while writing data or underlining on the copies requires much labor when many copies are required. Moreover, it is sometimes difficult to write on copies due to the impregnation of the paper substrate with silicone oil used in the fusing of the images to the substrate.

Recent developments in imaging systems have obviated the foregoing problems by the provision of methods and apparatus to reproduce an altered copy of the original document, as well as an identical copy thereof. Thus, recent innovations in printing machines provide for reproducing a document without unwanted information of the original document, and with the addition of new data thereto. In this way, the machine performs an editing function which significantly reduces the labor and time in preparing revised copies from the original document. Another editing function relates to highlighting an area of a document to be copied or printed in a color different from the rest of the document.

The latent image of an original document, formed by scanning the original document and projecting a light image thereof onto the charged portion of the photoconductive surface so as to selectively discharge the charge thereon, may be altered in various ways. The latent image may be edited by superimposing thereover an electrically modulated beam, such as a modulated laser beam, or the like. The modulated laser beam adds additional information or erases information from the scanned latent image. In this way, the resultant copy is altered from the original document. Various techniques have been devised for transmitting an electrical signal to modulate the laser so that the desired information is recorded on the latent image. The latent image may also be altered by selective actuation of light emitting diodes which are positioned perpendicular to the process direction of the printing machine.

The Panasonic E2S copier system uses an electronic pad to edit, board allows information recorded on a blackboard sized electronic board to be copied automatically by a copying machine on a copy sheet. In order to define the area that is to be altered, the coordinates of the relevant information on the original document to be modified must be transmitted to the printing machine.

The NP 3525 and Color Laser Copier manufactured by the Canon Corporation employs an edit pad which enables selected portions of a copy to be deleted. The NP 3525 and Color Laser Copier edit pad also permits color highlighting of designated areas of the document.

The formation of image areas to be highlighted is disclosed in U.S. Pat. No. 4,742,373. Highlighting in accordance with the disclosure of this patent is effected by using an editing pad to designate x,y coordinate values of information to be highlighted. The output from the editing pad is utilized to vary the intensity of a bank of light emitting diodes (LEDS) positioned perpendicular to the process direction of a charge retentive surface. Thus, for highlighting certain information of the original document, the LEDS are operated at half intensity. While the disclosure of this patent appears to be silent as to the actual method of developing such an image, it is customary to use two developer housings containing different color developers for this purpose which develop the electrostatic image at substantially less than the full contrast voltage.

For the purpose of creating optimum quality highlight color images in a single pass, it is desirable to use a scavengeless development system, at least in the second of the two developer housings employed. A scavengeless development system is one where the developer has minimal interaction with the toned images already formed on the charged retentive surface. Optimally, it would be advantageous if all interaction of developers with the image receiver could be avoided. A scavengeless development system is disclosed in U.S. Pat. No. 4,868,600 granted on Sep. 19, 1989 to Hays et al and assigned to the same assignee as this application. As described therein, toner is liberated from a donor roll by the application of an AC voltage to wires spaced from the donor roll by the toner thickness thereon. A DC bias applied across the gap between the donor roll and an image receiver controls development of the latent image by the liberated toner.

In the usual xerographic process, a bi-level electrostatic image is developed with a single color toner such as black toner. Multi-colored xerographic copies or prints prepared by the development of multiple bi-level electrostatic images require registered superposition of the developed images. Such multi-colored xerographic copies/prints derived from bi-level images can be made by using either several colored marking engines in tandem for single pass throughput or a single marking engine with multiple sequential colored imaging.

For a tri-level electrostatic image, highlight color printing can be obtained in a single pass with perfect registration. Since the black and color images are developed with opposite polarity toners, pre-transfer charging of the toner is required.

Pulsed voltage measurements with a scavengeless development system such as disclosed in U.S. Pat. No. 4,868,600 have shown that one can switch development on and off over a distance of only ~0.5 mm on the image receiver. U.S. Pat. No. 4,913,348 granted to Dan A. Hays on Apr. 3, 1990 describes a spatially programmable development process whereby the rapid development switching of scavengeless colored development systems utilizing an AC biased wire enables the selective coloring of an electrostatic image in the direction parallel to the process. Such selective coloring is accomplished in a single pass of a charge retentive surface through various process stations.

Other devices capable of developing different colored images in a single pass in the direction parallel to the process direction are disclosed in various U.S. Patents as follows:

U.S. Pat. Nos. 4,710,016 and 4,754,301 disclose imaging apparatuses which utilize two colored developer housings which are adapted to be selectively moved between development and nondevelopment positions relative to the charge retentive surface.

U.S. Pat. No. 4,752,802 illustrates a magnetic brush development system designed so that toner or developer can be withdrawn from the development zone without having to move the developer housing away from the charge retentive surface as required in the '301 patent. Two developer units are employed and are selectively used for each copying operation by the operator manipulating a selector switch provided on a control panel. At least one developing unit of the two component magnetic brush type is disposed opposite an electrostatic latent image receiver. The developing units have a developing sleeve in which is housed a magnetic core assembly that can be oriented by a drive means to switch development on and off by controlling the height of the developer in the development zone and the amount of developer metered onto the roll. The rotatabe developing sleeve is turned on and off simultaneously with the magnet orientation to switch development on and off, respectively. For development, the magnetic core assembly is so rotated that a weak magnetic or non-magnetic portion is at a position opposite to a level regulating member, and a high magnetic field is at a position opposite to the electrostatic latent image carrier. Furthermore, the rotating sleeve is stopped when development is switched off. Thus, to switch off development, the developing powder present on the outer periphery of the developing sleeve is shunted away from the developing zone and the sleeve rotation stopped. Such shunting of the developing powder is carried out with any of the developing units other than one selected for developing. Since development is obtained with a strong magnetic field in a zone adjacent to the electrostatic latent image carrier, the transitional width for switching color development is ~8 mm. This implies that information separated by less than 8 mm in the process direction cannot be color separated by this process.

U.S. Pat. No. 4,811,046 granted on Mar. 7, 1989 to Jerome E. Mays and assigned to the same assignee as this application discloses a tri-level image development system comprising two developer housings, each containing at least two magnetic brush developer rolls. The developer rolls in one of the housings are adapted to be reverse rotated for the purpose of removing toner material from the development zone formed by the two rolls and a charge retentive surface.

While not specifically related to color imaging, U.S. Pat. No. 4,568,955 issued on Feb. 4, 1986 to Hosoya et al may be relevant to other aspects of the present invention. This patent discloses a recording apparatus wherein a visible image based on image information is formed on an ordinary sheet by a developer. The recording apparatus comprises a developing roller spaced at a predetermined distance from and facing the ordinary sheet and carrying the developer thereon. It further comprises a plurality of addressable recording electrodes positioned behind the ordinary sheet and connected to signal sources for attracting the developer on the developing roller to the ordinary sheet by generating an electric field between the ordinary sheet and the developing roller according to the image information. A plurality of mutually insulated electrodes are provided on an insulative developing roller and extend therefrom in one direction. AC and DC voltage sources are connected to the electrodes, for generating alternating electric fringe fields between adjacent ones of the electrodes to cause oscillations of the developer positioned between the adjacent electrodes along electric lines of force therebetween to thereby liberate the developer from the developing roller.

As will be appreciated, selective coloring in a direction perpendicular to the process direction together with coloring in a direction parallel to the process direction is highly desirable.

BRIEF SUMMARY OF THE INVENTION

In accordance with the present invention, a process is disclosed for selectively coloring a bi-level electrostatic latent image in directions both parallel and perpendicular to the process direction. Two-direction image coloring is accomplished in a single pass with multiple resident colored development systems.

High resolution bi-level electrostatic images are formed using a laser Raster Output Scanner (ROS). An LED array or ionographic image bar may also be employed. Selective coloring of the electrostatic image is obtained through a combination of 1) a scavengeless development nip enabled by an AC biased wire in self-spaced contact with a toned donor roll, 2) a belt image receiver such as either a photoreceptor or electroreceptor without a ground plane and 3) an array of addressable, stationary electrodes positioned behind the belt in alignment with the AC biased wire. The AC biased wire produces a toner cloud which is only ~250 μm wide for a ~90 μm tungsten wire.

Selective coloring of electrostatic images is obtained by DC biasing the individual electrodes of stationary electrodes positioned behind the belt which is a ground-plane-less belt having an electrostatic latent image thereon. By controlling the level and timing for applying a DC bias to each electrode segment, the developability can be switched on and off with x,y addressability in the plane of the electrostatic image. Thus, with a system having resident multi-colored development systems, different areas of the electrostatic image can be developed in a single pass with different colors and perfect registration simply by controlling the DC electrical signals to the electrodes. The spatial resolution for image coloring is limited to ~500 μm in the process direction. Two closely spaced, AC biased wires could also be used but this would decrease the spatial resolution. In the direction perpendicular to the process, the spatial resolution should be limited to ~250 μm which is comparable to the spacing between the donor and receiver. A spatial resolution of ~500 μm in both directions corresponds to a spatial frequency of 1 line pair per millimeter.

DETAILED DESCRIPTION OF THE PREFERRED EMBODIMENT OF THE INVENTION

Figure 1:
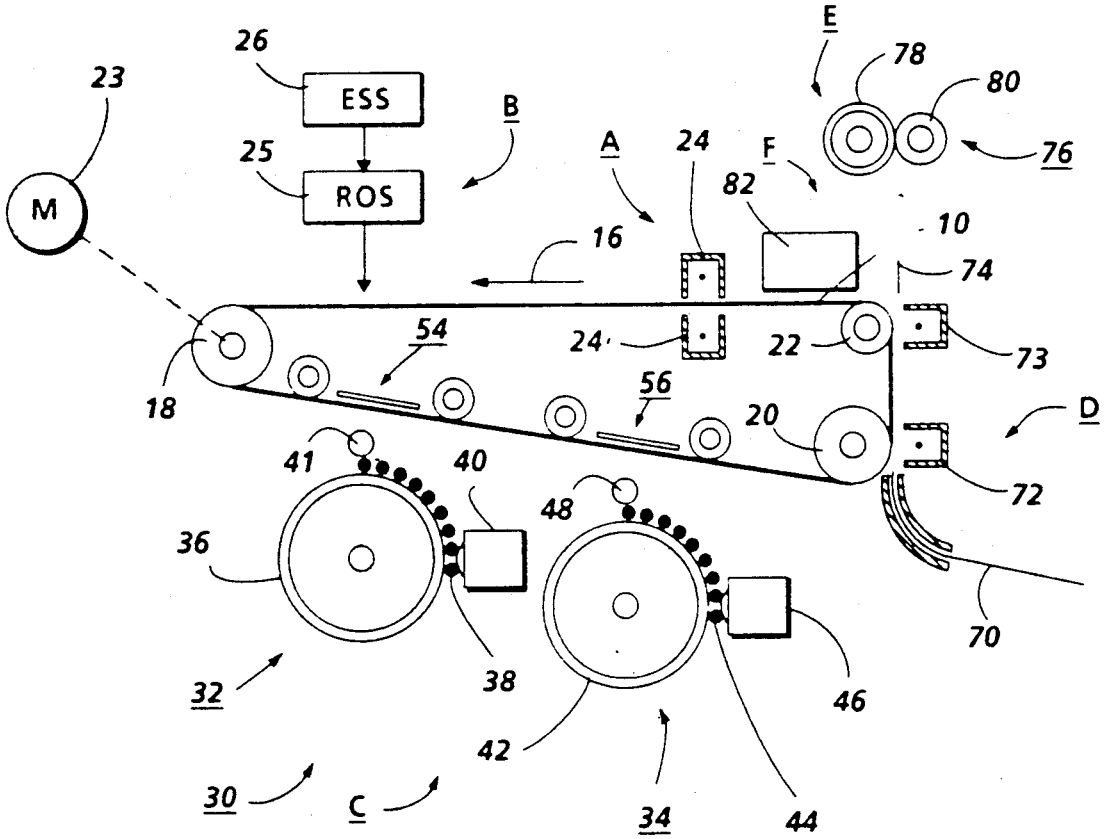
FIG. 1 is schematic illustration of a printing apparatus incorporating the development system features of our invention.

As shown in FIG. 1, a printing machine incorporating the invention may utilize a charge retentive member in the form of a photoconductive belt 10 comprising a self-supporting photoconductive insulating member mounted for movement past a charging station A, imaging or exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of the arrow 16. Roller 18 is coupled to motor 23 by suitable means such as a belt drive.

As can be seen by further reference to FIG. 1, successive portions of belt 10 pass through charging station A. At charging station A, corona discharge devices such as scorotrons, corotrons or dicorotrons indicated generally by the reference numeral 24 and $\mathbf{24}_1$ charge the belt 10 to a selectively high uniform positive or negative potential on the front side and an opposite uniform charge on the backside. Preferably charging on the front side is negative. Any suitable control, well known in the art, may be employed for controlling the corona charging devices 24 and $\mathbf{24}_1$.

Next, the charged portions of the photoreceptor surface are advanced through exposure station B. At exposure station B, the uniformly charged photoreceptor or charge retentive surface 10 may be exposed to either an illuminated document imaged through a lens or light from a digitally modulated light source such as a scanning laser or light emitting diode array. The imagewise light exposure causes the uniformly charged surface to be modified in accordance with the desired electrostatic image. For illustrative purposes, a two level (i.e. full-on or full-off) laser ROS 25 is disclosed.

For the laser ROS exposure system, the full-on state of the ROS corresponds to background information and the full-off state to image information. Thus, the areas exposed to the ROS output contain discharged areas which correspond to background areas and charged areas which correspond to image areas. The charged image voltage is approximately minus 500 volts while the background voltage level is approximately minus 100 volts. A computer program stored in an Electronic Subsystem (ESS) 26 generates digital information signals for operating the ROS in accordance with the latent images to be formed on the imaging member 10.

At development station C, a development system, indicated generally by the reference numeral 30, advances developer materials into development zones $Z_1$ and $Z_2$. The development system 30 comprises first and second toner delivery systems 32 and 34. The toner delivery system 32 comprises a donor structure in the form of a roller 36. The donor structure 36 conveys a toner layer to the development zone, $Z_1$. The toner layer can be formed on the donor 36 by either a two component developer or single component toner 38 deposited on donor structure 36 via a combination single component toner metering and charging device 40. The development zone, $Z_1$ contains an AC biased electrode structure 41 self-spaced from the donor roll 36 by the toner layer 38. The single component toner 38 as illustrated in FIG. 1 comprises, by way of example, positively charged black toner. The donor roller 36 is preferably coated with TEFLON-S (trademark of E.I. DuPont De Nemours) loaded with carbon black.

For single component toner, the combination metering and charging device 40 may comprise any suitable device for depositing a monolayer of well charged toner onto the donor structure 36. For example, it may comprise an apparatus such as described in U.S. Pat. No. 4,459,009 wherein the contact between weakly charged toner particles and a triboelectrically active coating contained on a charging roller results in well charged toner. Other combination metering and charging devices may be employed. For donor roll loading with two component developer, a conventional magnetic brush can be used for depositing the toner layer onto the donor structure.

The electrode structure 41 is comprised of one or more thin (i.e. 50 to 100 μm diameter) tungsten wires which are lightly positioned against the donor structure 36. The distance between the wires and the donor is self-spaced by the thickness of the toner layer which is approximately 25 μm. The extremities of the wires are supported by end blocks at points slightly below a tangent to the donor roll surface. Mounting the wires in such manner makes the self-spacing insensitive to roll runout.

The toner delivery system 34 is similar to the first delivery system 32. FIG. 1 shows the donor structure 42 conveying single component developer 44 deposited thereon via a combination metering and charging device 46 to an electrode structure 48 in a second development zone. The single component toner in this case comprises colored toner, for example red toner. The donor structure can be rotated in either the 'with' or 'against' direction vis-a-vis the direction of motion of the charge retentive surface. While the difference between the toners resides in their color it will be appreciated that the difference may also reside in different physical properties such as magnetic state.

Figure 2:
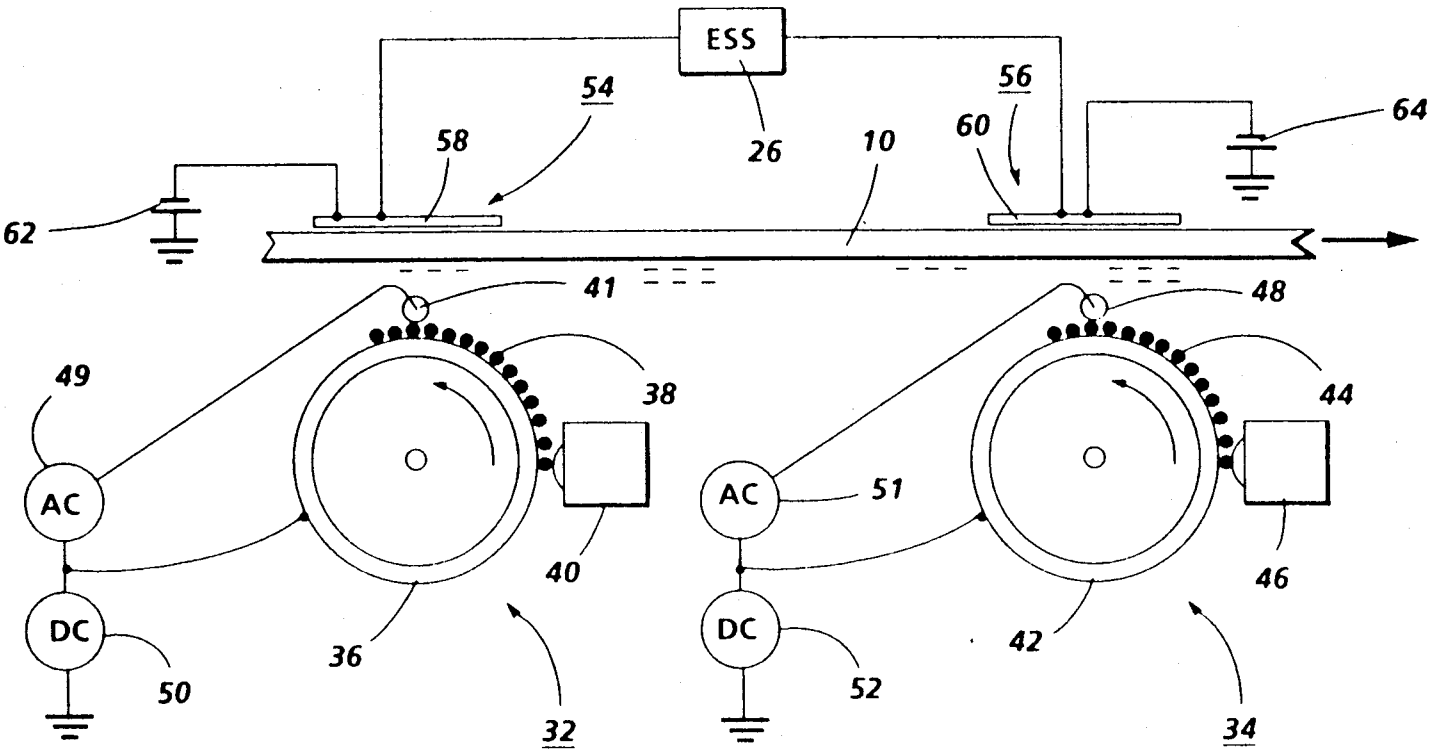
FIG. 2 is is a schematic illustration of a pair of development structures employed in the printing apparatus of FIG. 1.

As shown in FIG. 2, an alternating electrical bias is applied to the electrode structure 41 via an AC voltage source 49. The applied AC establishes an alternating electrostatic field between the wires and the donor structure which is effective in detaching toner from the surface of the donor structure and forming a toner cloud about the wires, the height of the cloud being such as not to contact with the charge retentive surface. The magnitude of the AC voltage is relatively low and is in the order of 200 to 300 volts peak at a frequency of about 4 kHz up to 10 kHz. A DC bias supply 50 applies a voltage to the donor structure 42 which establishes an electrostatic field between the charge retentive surface of the photoreceptor 10 and the donor structure for the purpose of providing an electric field to suppress toner deposition in the discharged area latent image on the charge retentive surface and attracting the detached toner particles from the cloud surrounding the wire 41 to the charged area images. A DC bias of approximately −200 volts is used for the developement of charged area images.

A similar alternating electrical bias is applied to the electrode structure 48 via an AC voltage source 51. The applied AC establishes an alternating electrostatic field between the wires and the donor structure which is effective in detaching toner from the surface of the donor structure and forming a toner cloud about the wires, the height of the cloud being such as not to contact with the charge retentive surface. The magnitude of the AC voltage is relatively low and is in the order of 200 to 300 volts peak at a frequency of about 4 kHz up to 10 kHz. A DC bias supply, also 52 applies a voltage to the donor structure 42 which establishes an electrostatic field between the charge retentive surface of the photoreceptor 10 and the donor structure for the purpose of providing an electric field to suppress toner deposition in the discharged areas on the charge retentive surface and attracting the detached toner particles from the cloud surrounding the wire 48 to the charged area images. A DC bias of approximately −200 volts is used.

At a spacing of approximately 25 μm between the electrode structure and donor structure, an applied AC voltage of 200 to 300 volts peak produces a relatively large electrostatic field without risk of air breakdown. The use of a dielectric coating on the roll structures 36 and 42 helps to prevent shorting of the applied AC voltage. The maximum field strength produced is in the order of 10 to 20 V/μm. While the AC bias is illustrated as being applied to the electrode structure it could equally as well be applied to the donor structure.

Figure 3:
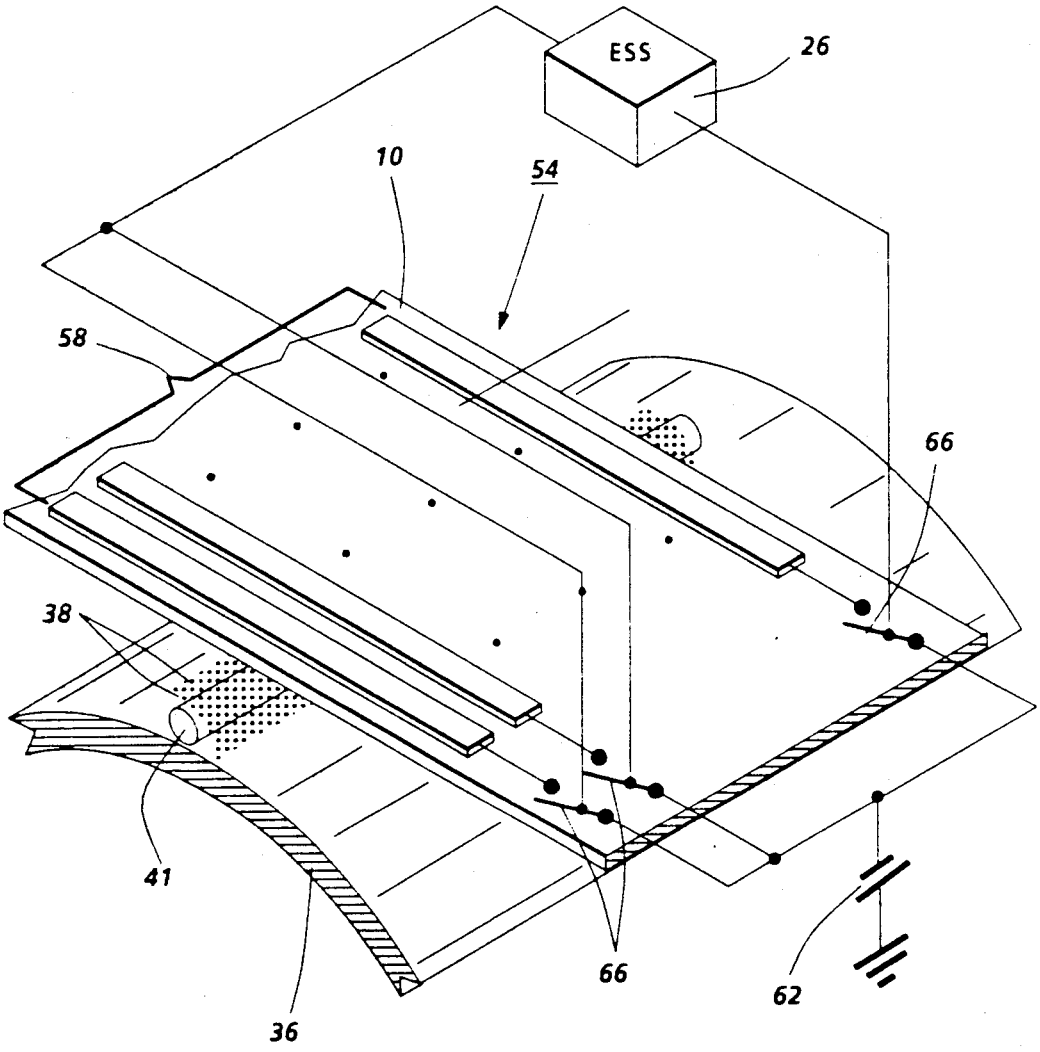
FIG. 3 is an enlarged partial, schematic view of an image coloring device capable of selectively coloring an image both parallel and perpendicular to the process direction.

Selective coloring of the electrostatic image is obtained by selectively DC biasing addressable, stationary electrode structures 54 and 56 (FIG. 3 and 4) forming electrode arrays positioned behind the belt 10. By controlling the level and timing for applying a DC bias to each electrode segments 58 and 60, respectively of the arrays 54 and 56 development is switched on and off with x,y addressability in the plane of the electrostatic image. Thus, with a system having resident multi-colored toner delivery systems, different areas of the electrostatic image can be developed in a single pass with different colors and perfect registration simply by controlling the DC electrical signals to the electrodes. The spatial resolution for image coloring is limited to ~500 μm in the process direction. Two closely spaced, AC biased wires 41 could also be used but this would decrease the spatial resolution. The same would be true if two AC biased wires 48 were used.

DC power sources 62 and 64 are operatively connected to selected electrodes 58 and 60 via suitable switches 66. Timing of switch actuation is controlled by image information processed via the ESS 26.

In the direction perpendicular to the process, the spatial resolution should be limited to ~250 μm which is comparable to the spacing between the donor and receiver. A spatial resolution of 500 μm in both directions corresponds to a spatial frequency of 1 line pair per millimeter.

A key enabling technology for the present invention is the provision of a belt photoreceptor or electroreceptor that does not have a substrate or ground plane. U.S. Pat. No. 2,955,938 granted to F. A. Steinhilper on Oct. 11, 1960 discloses imaging members in the form of plates comprising photoconductive insulating layers on insulating support layers and also self-supporting films of photoconductive insulating material.

The ground plane on photoreceptors and electroreceptors serves, in conventional xerography, as a convenient method for providing a required countercharge on the backside of the dielectric when charge in the form of ions or charged particles are deposited on the front surface. But the ground plane also shields the front surface from any electric fields applied from the backside. This characteristic is undesirable in the present invention wherein an electrode array is positioned adjacent the backside of the image receptor to provide spatially dependent electric fields on the front side of the receptor in the development zone.

If a ground plane is not used when the photoreceptor or electroreceptor is charged, the countercharge on the backside must be supplied by another source such as ions from a corona device. For the case of a photoreceptor, a source of countercharge is not required during the exposure step since the net charge on the photoreceptor is unchanged. However, in the development of either a photoreceptor or electroreceptor, net charge is added in the form of toner. If 0.6 mg/cm$^2$ of 10 μC/gm toner is developed to give a maximum optical density, the net charge density on the dielectric belt is 6 μC/cm$^2$ which will have an electric field near air breakdown (3 V/μm) on each side. If a higher developed toner charge density is required, a countercharge would be required which could be supplied by either an active or passive ion source.

A source of countercharge is not required for image transfer by a bias roll or corona device provided the dielectric is backed with a grounded shoe or roll, (not shown) in connection with the transfer and detack corona devices to be discussed hereinafter.

The magnitude of the DC bias required to switch a scavengeless development nip on and off will now be discussed. For normal scavengeless development, the solid area development curve is essentially linear in the difference between the surface potential of the image receiver, $V_I$, and the bias on the donor roll, $V_D$, where the biases are referenced to ground potential. The threshold for development occurs at $V_T = V_I - V_D$ where $V_T$ is approximately −50 volts for negatively charged toner. The contrast image potential for $D_{max}$ is 300 volts. Now when the image receiver does not have a ground plane, the development field depends on $V_I - V_D + V_E$ where is the bias on an electrode segment. When $V_E$ is set at ground potential, normal development of an electrostatic image will occur. However, if $V_E$ is set at −300 volts, no image development will occur. By switching the bias between 0 and minus 300 volts for each electrode segment at the appropriate times; one can obtain spatial control of the toner available for development at a spatial frequency resolution of about 1 line pair per millimeter. Switching the electrode bias to intermediate values could provide gray scale capability.

For copier applications, an edit pad is required to color convert or delete portions of the image. The resident color development systems might consist of any combination of black, red, blue, green, cyan, magenta, yellow and custom colors. The subtractive colors could be used to provide dialable custom color provided sufficient image contrast is available for multiple development of the same electrostatic image area.

For printer applications, the areas of the document to be colored such as logos, titles, words, etc. are designated on a color CRT using the text editor. Since the digital description of the color information is at a relatively low resolution of ~1 line pair per millimeter compared to the high resolution of the electrostatic image (120 spots/cm), the requirements for the electronic subsystem are relaxed in comparison with tri-level highlight color images or full color xerographic processes. For example, the memory required to digitize a bi-level electrostatic image for a single print at (120 spots/cm) is 1.0 megabyte. A tri-level image for highlight color would require twice as much memory. The memory requirements for the coloring process described herein would be considerably less at 1.0+0.03 megabytes for a single highlight color print. The reduced memory requirements could lower the cost of the ESS for colored printers which presently represents a substantial fraction of the total printing system cost. The black and colored images produced by the coloring process would be of equally high resolution and the smallest colored image objects would be represented by lines and alphanumerics.

A family of coloring printers are envisioned including simple systems with black and single interchangeable color development systems to more complicated systems with multi-colored development systems that in addition can be biased to develop the image receiver with continuous colored tones in areas that do not contain an electrostatic image. This could enable making prints which have a pictorial characteristic. It would seem, however, that a coloring printer that has black and several color resident development systems represents the best system design. This would enable one to print several highlight colors and MICR on a print in a single pass with perfect registration. The world of lithographically produced highlight color printing contains many examples of prints such as letterheads, newsletters, notices, signs, advertising, etc. that could be produced by a workstation in conjunction with a printer based on the proposed process.

The detailed discussion of the preferred embodiment described herein has entailed a description of two different resident development systems which contain toner with different physical properties such as color or magnetic character. It is intended that a multiplicity of resident development systems could be included to provide a wide selection of color and magnetic toners for coloring many different image areas in a single pass process. The selection of colors could also be used to create additional colors by depositing different colored toners in the same image area.

Referring once again to FIG. 1, a sheet of support material 70 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive belt 10 in a timed sequence so that the toner powder image developed thereon contacts the advancing sheet of support material at transfer station D.

Transfer station D includes a corona generating device 72 which sprays ions of a suitable polarity onto the backside of sheet 70. This attracts the charged toner powder images from the belt 10 to sheet 70. A paper detack corona device 73 can also be employed to aid removal of the paper from the photoconductive belt. After transfer, the sheet continues to move, in the direction of arrow 74, onto a conveyor (not shown) which advances the sheet to fusing station E.

Fusing station E includes a fuser assembly, indicated generally by the reference numeral 76, which permanently affixes the transferred powder image to sheet 70. Preferably, fuser assembly 76 comprises a heated fuser roller 78 and a backup roller 80. Sheet 70 passes between fuser roller 78 and backup roller 80 with the toner powder image contacting fuser roller 78. In this manner, the toner powder image is permanently affixed to sheet 70. After fusing, a chute, not shown, guides the advancing sheet 70 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner structure 82 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

What is claimed is:

1. Apparatus for creating contrasting images in a single pass, said-apparatus comprising:

means for moving an image receiver lengthwise past an imaging station;

a plurality of electrode arrays disposed adjacent one surface of said image receiver;

means for selectively biasing said electrode arrays;

a pair of toner delivery systems with a narrow development zone and positioned adjacent a surface of said image receiver opposite said one surface, each being positioned opposite one of said electrode arrays;

said toner delivery systems containing toners having different physical properties; and means for actuating said toner delivery systems simultaneously with the selective biasing of the electrodes of the electrode array associated therewith for effecting selective deposition of toner particles having different physical properties on said image receiver in areas thereof corresponding to the position of said image receiver relative to said electrodes at the time of said biasing.

2. Apparatus according to claim 1 including means for uniformly charging said image receiver; and means for forming latent electrostatic images on said image receiver.

3. Apparatus according to claim 2 wherein said image receiver comprises a ground-plane-less charge retentive member.

4. Apparatus according to claim 2 wherein said image receiver comprises a self-supporting film of photoconductive insulating material.

5. Apparatus according to claim 2 wherein said image receiver comprises a photoconductive insulating layer on an insulating support layer.

6. Apparatus according to claim 3 including means for transferring toner images from said charge retentive member to a final substrate; and means for fixing said transferred toner images to said substrate.

7. Apparatus according to claim 6 wherein each of said electrode arrays comprises a plurality of elongated electrodes extending in the process direction.

8. Apparatus according to claim 7 wherein said plurality of electrodes are positioned substantially coextensively with the extent of said image receiver in the direction perpendicular to the direction of movement of said charge retentive member.

9. Apparatus according to claim 8 wherein said means for forming latent electrostatic images on the surface of said charge retentive member opposite said one surface comprises means for forming bi-level image patterns.

10. Apparatus according to claim 9 wherein said means for forming bi-level image patterns comprises a laser ROS.

11. Apparatus according to claim 10 wherein said different physical properties comprises different colors.

12. Apparatus according to claim 11 wherein said toners are charged to the same polarity.

13. Apparatus according to claim 11 wherein one of said toners is magnetic and one is non-magnetic.

14. A method for creating contrasting images in a single pass, said method including the steps of:

moving an image receiver lengthwise past a plurality of process stations;

positioning a plurality of electrode arrays adjacent one surface of said image receiver;

selectively biasing said electrode arrays;

positioning a pair of toner delivery systems with a narrow development zone and adjacent a surface of said image receiver opposite said one surface, each being positioned opposite one of said electrode arrays;

providing toners in said toner delivery systems having different physical properties; and actuating said toner delivery systems simultaneously with the selective biasing of the electrodes of the electrode array associated therewith for effecting selective deposition of toner particles having different physical properties on said image receiver in areas thereof corresponding to the position of said image receiver relative to said electrodes at the time of said biasing.

15. The method according to claim 14 including the steps of uniformly charging said image receiver; and forming latent electrostatic images on said image receiver.

16. The method according to claim 15 wherein said step of moving an image receiver comprises moving a ground-plane-less charge retentive member.

17. The method according to claim 15 wherein said image receiver comprises a self-supporting film of photoconductive insulating material.

18. The method according to claim 15 wherein said image receiver comprises a photoconductive insulating layer on an insulating support layer.

19. The method according to claim 16 including the steps of transferring toner images from said charge retentive member to a final substrate; and fixing said transferred toner images to said substrate.

20. The method according to claim 19 wherein the step of positioning a plurality of electrode arrays comprises positioning a plurality of elongated electrodes extending in the process direction.

21. The method according to claim 20 wherein said plurality of electrodes are positioned substantially coextensively with the extent of said image receiver in the direction perpendicular to the direction of movement of said charge retentive member.

22. The method according to claim 21 wherein said step of forming latent electrostatic images patterns on the surface of said charge retentive member opposite said one surface comprises means for forming bi-level image patterns.

23. The method according to claim 22 said step of for forming bi-level image patterns comprises using a laser ROS.

24. The method according to claim 23 wherein said different physical properties comprises different colors.

25. The method according to claim 24 wherein said toners are charged to the same polarity.

26. The method according to claim 24 wherein one of said toners is magnetic and one is non-magnetic.

* * * * *